United States Patent [19]

Curley

[11] Patent Number: 4,592,171

[45] Date of Patent: Jun. 3, 1986

[54] PAPER DRILL BIT SHARPENER

[76] Inventor: Richard D. Curley, 265 Prado Road, #1, San Luis Obisbo, Calif. 93401

[21] Appl. No.: 770,383

[22] Filed: Aug. 28, 1985

[51] Int. Cl.[4] ..... B24B 19/00

[52] U.S. Cl. ..... 51/246; 51/288; 51/170 PT

[58] Field of Search ..... 51/246, 241 R, 245, 51/247, 248, 288, 170 R, 170 PT, 173

[56] References Cited

U.S. PATENT DOCUMENTS 1,096,875 5/1914 Weeks ..... 51/170 R 2,952,101 9/1960 Carlson ..... 51/288

*Primary Examiner*—Roscoe V. Parker

*Attorney, Agent, or Firm*—Boniard I. Brown

[57] ABSTRACT

A sharpening head with a conical stone or burr is spring biased for application to the end of a spinning paper drill bit brought down on the apex of the cone. As the drill depresses the head, a pin extends through the apex of the cone to push any paper scrap out of the end to be sharpened and up into the drill. This assures that the sharpening force between the head and the drill bit is determined by the bias of the spring. The spring forces the sharpening head linearly upwardly along the pin and within an internal cylinder in a base which encloses a cylindrical extension of the head. In an alternative embodiment, spacer blocks and a lever are provided to adjust the initial height of the sharpening head. The alternative embodiment is useful to sharpen automated paper drills whose range of movement is relatively fixed.

22 Claims, 8 Drawing Figures

PAPER DRILL BIT SHARPENER

BACKGROUND OF THE INVENTION

Paper drills normally are used to cut holes in stacks of paper too thick for paper punches. Such drills usually employ bits constructed from a hollow tube with a paper scrap opening at one end and a sharpened hollow circular edge at the other. The sharpened circular edge normally is positioned at the intersection of a conical inner surface and the cylindrical outer surface of the tube. The conical inner surface is formed by cutting on the end of the tube with the apex of a conical sharpening head inserted therein. For such a paper drill bit to work well, its circular edge must be extremely sharp. Once a drill bit has become dull and is full of paper scrap, resharpening becomes a time consuming and difficult operation. Usually the drill bit must be removed from its drill press and placed on a special set up for sharpening by a spinning sharpener. This is time consuming and results in excessive down time of the drilling operation. Therefore, there has been a need to provide an easy to use paper drill bit sharpening apparatus which can tolerate the normal clogged condition of a paper drill bit and does not require the removal of the bit from the drill press or other machinery in which it is mounted.

SUMMARY OF THE INVENTION

The present paper drill bit sharpener includes a base with a flat undersurface and a cylindrical cavity which preferably is positioned at a right angle to the flat undersurface. A sharpener head having a cylindrical portion and a conical sharpening portion, is mounted for linear sliding movement along the cylindrical cavity. Bias means are provided between the base and the head to provide the correct sharpening force when a drill bit is brought together with the conical sharpening portion. The bias means also may prevent rotation of the head.

A pin passes through the head, extending out the apex of the conical sharpening portion and through the center of the base of the cylindrical portion so that when a spinning drill bit is brought down over the apex of the conical portion for sharpening, the pin pushes any paper scrap up into the drill and out of the way of the sharpening operation. Therefore, by substituting the present sharpener for the stack of paper, a drill bit in its drill can be sharpened quickly and accurately by an operator with little skill. When the bits to be sharpened are in automated paper drills where the amount of travel thereof is fixed, a modified embodiment of the present invention with a lever actuated head is used. The modified embodiment is blocked up by spacers so its head is just below the proper height. Then the lever is used to move the sharpening head, the bias means and the center pin upwardly into proper sharpening engagement with the paper drill bit.

It is therefore an object of the present invention to provide a paper drill bit sharpening device which can be used without removing the bit to be sharpened from its drill press.

Another object is to provide a paper drill bit sharpener which is economic to construct, easy to use and can accurately sharpen a paper drill without removing excess material or flaring the cutting edge thereof.

Another object is to provide a paper drill bit sharpening device which can be used when the dull bits are installed in either manual or automated paper drills.

These and other objects and advantages of the present invention will become apparent to those skilled in the art after considering the following detailed Specification together with the accompanying drawings wherein:

DETAILED DESCRIPTION OF THE SHOWN EMBODIMENTS

Figure 1:
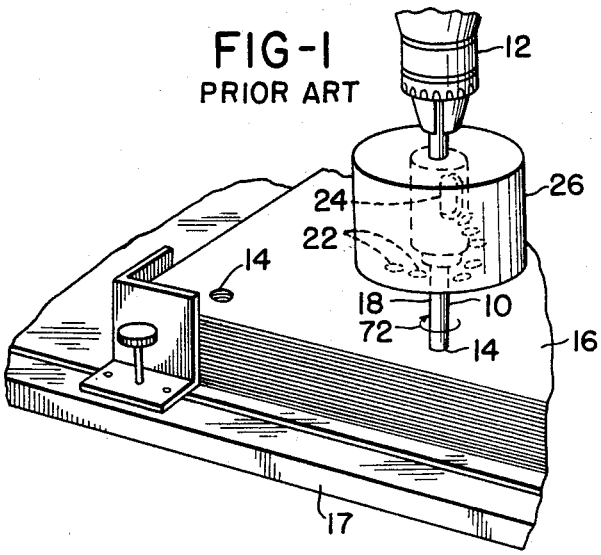
FIG-1 PRIOR ART
FIG. 1 is a perspective fragmentary view of a prior art paper drill being used to drill holes in a stack of paper.

Referring to the drawings more particularly by reference numbers, number 10 in FIG. 1 refers to a paper drill being spun by a drill 12 to drill holes 14 in a stack of paper 16 resting on a table 17. The paper drill 10 is typical in that it includes a hollow drill bit 18 whose lower circular edge 20 (FIG. 2) is sharpened by an internal frustroconical surface 21 (FIG. 3). The drill bit 18 when spun and brought into engagement with the stack of paper 16 as shown in FIG. 1, cuts a circle of paper scrap 22 or chaff out of each layer of paper 16 as it passes downwardly therethrough. The paper scrap 22 moves up inside the hollow bit 18 until it is pushed out through a side orifice 24 of the bit 18 and into a container 26 by later cut scrap 22. Unfortunately, paper 16 has abrasive qualities which soon dull the edge 20 so that it requires resharpening.

Figure 2:
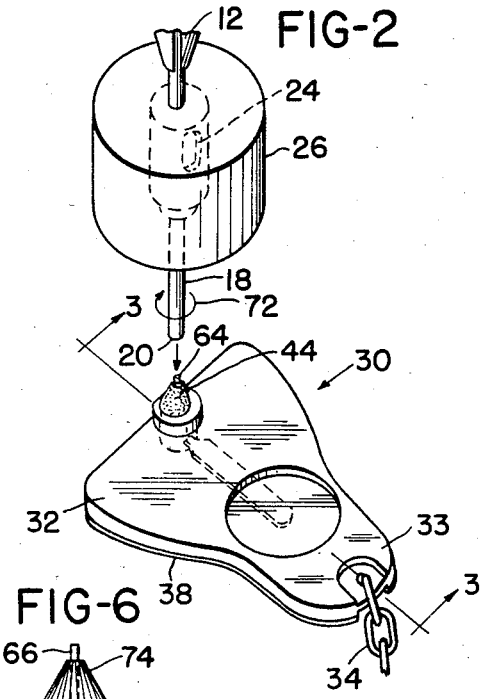
FIG. 2 is a perspective view of the present invention as it is positioned at the start of a sharpening operation for the paper drill of FIG. 1.
Figure 3:
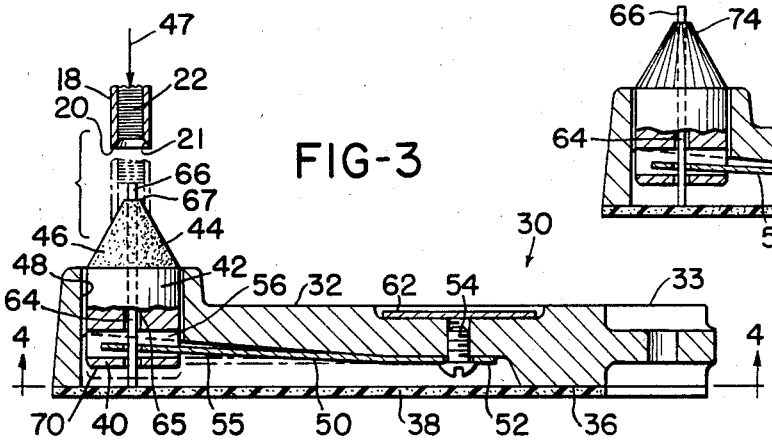
FIG. 3 is an enlarged cross-sectional view taken at line 3—3 in FIG. 2 showing the start of a paper drill bit sharpening operation.
Figure 8:
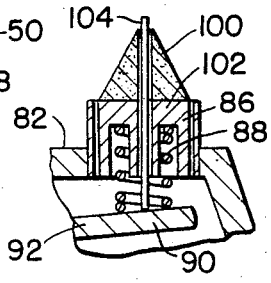
FIG. 8 is an enlarged view of the sharpening head of FIG. 7.

A paper drill bit sharpener 30 constructed according to the present invention is shown in FIGS. 2 and 3. The sharpener 30 includes a base 32 which is adapted at one end 33 for connection to attachment means such as the chain 34 shown. This chain 34, if properly secured, can assure that the sharpener 30 remains in the close vicinity of the paper drilling operation. The base 32 has a flat underside 36 which preferably is formed by a layer 38 of magnetic material. Since most drill tables 17 are constructed from magnetizable material, the magnetic layer 38 assists in retaining the sharpener 30 in proper position during a drill bit sharpening operation.

When a drill bit 18 is to be sharpened, the sharpener 30 is positioned with its drill sharpening head 40 directly beneath and in the path of the drill bit 18. The head 40 includes a lower cylindrical portion 42 and an upper conical portion 44. The conical portion 44 may have an abrasive surface coating 46, such as diamond dust and aluminum oxide, or the conical portion 44 may be solid abrasive. BORAZON, an aluminum oxide sold by the General Electric Company is particularly effective. The head 40 is restricted to linear movement parallel to the motion 47 of the bit 18 by having its cylindrical portion 42 positioned in a cylindrical bore 48 oriented at a right angle to the underside 36 of the base 32.

Figure 5:
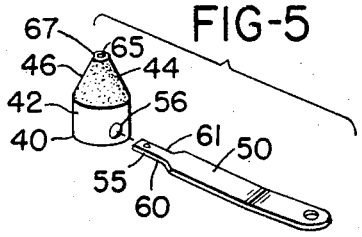
FIG. 5 is an exploded view of the sharpening head and bias means therefor of FIGS. 2 through 4.
Figure 4:
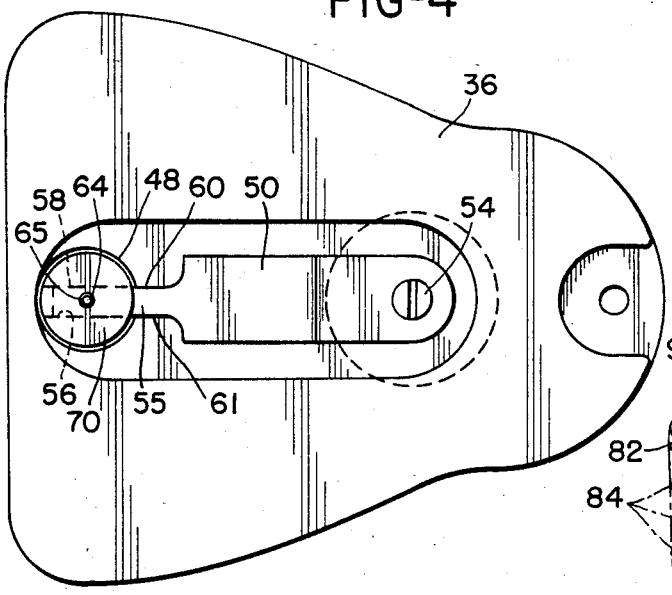
FIG. 4 is a bottom view taken on line 4—4 of FIG. 3.

Biasing means are provided by a leaf spring 50, connected at one end 52 by a screw 54 to the base 32. As shown in FIGS. 4 and 5, the other end 55 of the leaf spring 50 extends within a transverse hole 56 in the cylindrical portion 42 and prevents its rotation with respect to the base 32. The end 55 is relieved on both sides 60 and 61 thereof for that purpose. A decorative product label 62 can be used to cover the screw 54. The leaf spring 50 can be preloaded against the adjacent undersurface of the base 32. In this way, the leaf spring 50 provides the correct, relatively constant, upward bias to the head 40 from the first instant of bit to sharpener contact.

A pin 64 extends upwardly through a central bore 65 in the cylindrical portion 42, the conical portion 44, and the end 58 of the spring 50 so that its upper end 66 extends up beyond the apex tip 67 of the conical portion 44.

As the drill bit 18 is brought down upon the conical portion 44, the end 66 of the pin 64 cannot move because its opposite end 68 abuts against the layer 38. Therefore, the end 66 of the pin 64 pushes the paper scrap 22 up and out of the way of the sharpener head 40. Thereafter, as the drill bit 18 is brought down upon the conical portion 44, the leaf spring 50, biases the abrasive 46 into the bit 18 to grind its inner frustroconical surface 21 and sharpen the edge 20. So long as the operator does not move the drill bit 18 so far down that the undersurface 70 of the cylindrical portion 42 hits the layer 38, the leaf spring 50 applies the proper sharpening force and the spinning of the paper drill bit 18 against the abrasive 46 accomplishes the desired sharpening. The bias provided by the leaf spring 50 is relatively light so that there is no tendency to flare out the bit 18 in the area of its sharpened edge 20.

Figure 6:
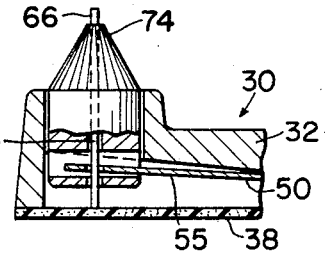
FIG. 6 is an enlarged detail view similar to a portion of FIG. 3 showing a carbide conical burr instead of the conical stone of FIGS. 2 through 5.

In some instances, where the drill bit 18 is always rotated the same direction, such as the direction shown by the arrow 72 in FIGS. 1 and 2, a carbide conical burr 74, as shown in FIG. 6, can be substituted directly for the conical portion 44 with its abrasive 46.

Figure 7:
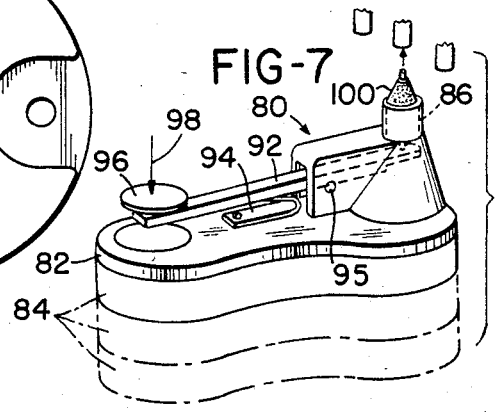
FIG. 7 shows a modified embodiment of the sharpener of FIGS. 2 through 6 useful with automated multiple spindle paper drills.

There are some paper drills 10 that are used in automated machinery where the low point of their bit travel cannot be manually controlled during a sharpening operation. In these instances, a sharpener 80, as shown in FIG. 7, is employed. The sharpener 80 is similar in construction to the sharpener 30 discussed above. However, its base 82 includes a plurality of removable spacer blocks 84 so that its height above a table 17 can be roughly adjusted. In the sharpener 80, a head 86, similar to head 40, is supported by a compression coil spring 88 on one end 90 of a lever 92, spring loaded by a second spring 94 against a pivot 95 so that its opposite end 96 is normally up. By applying force in the direction of arrow 98, the head 86 can be brought up into engagement with the drill bit 18. The conical and cylindrical portions 100 and 102 of the head 86 are supported by the spring 88 so they are free to move with respect to the lever 92 allowing the spring 88 to apply the sharpening force. The pin 104 which extends up through the center thereof however, is supported by the end 90 of the lever and therefore pushes the scrap paper 22 out of the sharpening area as was true with the sharpener 30.

Thus there has been shown and described novel paper drill bit sharpeners which fulfill all the objects and advantages sought therefore. Many changes, modifications, variations and other uses and applications of the subject invention will, however, become apparent to those skilled in the art after considering this Specification together with the accompanying drawings. All such changes, modifications, variations and other uses and applications which do not depart from the spirit and scope of the invention, are deemed to be covered by the invention which is limited only by the claims which follow.

What is claimed is:

1. A tool for sharpening hollow paper drill bits including:

a base having:

a lower planar surface; and a cavity which extends at a right angle to said lower planar surface;

a sharpener head having:

a conical sharpener portion for engagement with a bit to be sharpened; and a support portion shaped to fit in said cavity and to move therealong; and bias means between said sharpener head and said base to apply a sharpening force for application to the bit being sharpened from said base to said sharpener head.

2. The tool defined in claim 1 wherein said cavity and said support portion are cylindrical in shape.

3. The tool defined in claim 2 wherein said sharpener head is supported away from said base lower planar surface by said bias means.

4. The tool defined in claim 3 wherein said support portion includes:

a transverse passageway generally parallel to said base lower planar surface, said bias means including:

a leaf spring having:

a first end connected to said base; and a second end inserted in said transverse passageway of said support portion to bias said sharpener head and to restrict its rotation.

5. The tool defined in claim 4 wherein said sharpener head further includes:

a central passageway therein generally perpendicular to said base lower planar surface, said tool further including:

a pin extending through said central passageway, said pin having:

a first end extending out of said conical sharpener portion of said sharpener head; and a second end supported by said base, whereby said sharpener head can be moved along said pin against the bias of said leaf spring.

6. The tool defined in claim 5 wherein said conical sharpener portion of said sharpener head includes:

an apex spaced from said support portion, said pin extending through said apex for moving any scrap in the bit being sharpened away from said conical sharpener portion.

7. The tool defined in claim 6 wherein said leaf spring is preloaded against said base.

8. The tool defined in claim 7 wherein said base includes:

a magnetic portion adjacent said lower planar surface thereof.

9. The tool defined in claim 1 wherein said sharpener head is supported away from said base lower planar surface by said bias means.

10. The tool defined in claim 9 wherein said sharpener head further includes:
a central passageway therein generally perpendicular to said base lower planar surface, said tool further including:
a pin extending through said central passageway, said pin having:
a first end extending out of said conical sharpener portion of said sharpener head; and
a second end supported by said base, whereby said sharpener head can be moved along said pin against said bias means.

11. The tool defined in claim 10 wherein said base further includes:
a lever having:
a first end adapted for application of manual force;
a second end in engagement with said bias means and said pin; and
a central pivot connected to said base.

12. The tool defined in claim 11 wherein said lever further includes:
a spring positioned to move said bias means toward said base.

13. The tool defined in claim 12 wherein said bias means include:
a compression coil spring positioned between said sharpener head and said lever second end.

14. The tool defined in claim 9 wherein said sharpener head further includes:
a central passageway therein generally perpendicular to said base lower planar surface, said tool further including:
a pin extending through said central passageway, said pin having:
an end extending out of said conical sharpener portion of said sharpener head.

15. The tool defined in claim 14 wherein said base further includes:
a lever having:
a first end adapted for application of manual force;
a second end in engagement with said bias means; and
a central pivot connected to said base.

16. The tool defined in claim 15 wherein said lever further includes:
a spring positioned to move said bias means toward said base, and wherein said bias means include:
a compression coil spring positioned between said sharpener head and said lever second end.

17. A tool for sharpening hollow paper drill bits while the bit remains rotating in drill means above a platform and a central passageway of the drill bit may contain paper scrap adjacent its cutting surface which is frustroconical in said bit, said tool including:
a base having:
a lower planar surface adapted to rest on the platform of the drill means; and
a cavity which extends at a right angle to said lower planar surface;
a sharpener head having:
a conical sharpener portion for engagement with the frustroconical cutting surface of a bit to be sharpened;
a support portion shaped to fit in said cavity and to move therealong in response to force applied to said conical sharpener portion by the bit being sharpened; and
a central passageway therein generally perpendicular to said base lower planar surface;
bias means between said sharpener head and said base to apply a sharpening force for application to the bit being sharpened from said base to said sharpener head; and
a pin extending through said central passageway, said pin having:
a first end extending out of said conical sharpener portion of said sharpener head to engage and push the scrap away from the frustroconical cutting surface of the bit being sharpened; and
a second end supported by said base.

18. The tool defined in claim 17 wherein said sharpener head is mounted to move with respect to said pin.

19. The tool defined in claim 17 wherein said base further includes:
a lever having:
a first end adapted for application of manual force;
a second end in engagement with said bias means;
a central pivot connected to said base; and
a spring positioned to move said bias means toward said base, said bias means including:
a compression coil spring positioned between said sharpener head and said lever second end.

20. The tool defined in claim 17 wherein said support portion includes:
a transverse passageway generally parallel to said base lower planar surface, said bias means including:
a leaf spring having:
a first end connected to said base; and
a second end inserted in said transverse passageway of said support portion to restrict its rotation, said leaf spring being preloaded against said base to bias said sharpener head.

21. The tool defined in claim 17 wherein said conical sharpener portion includes:
an abrasive outer surface.

22. The tool defined in claim 17 wherein said conical sharpener portion includes:
a carbide conical burr cutter.

* * * * *